US006982115B2

(12) United States Patent
Poulos et al.

(10) Patent No.: US 6,982,115 B2
(45) Date of Patent: Jan. 3, 2006

(54) INTERACTIVE-DESIGN GARMENT WHERE THE WEARER CAN CREATE AND ALTER THE GRAPHIC DECORATION ON THE GARMENT AND METHOD OF MANUFACTURING SAME

(76) Inventors: Harry K. Poulos, 56 Jackson Ave., Hayworth, NJ (US) 07641; Steven Heimlich, 79-25 150th St., Flushing, NY (US) 11367

( * ) Notice: Subject to any disclaimer, the term of this patent is extended or adjusted under 35 U.S.C. 154(b) by 0 days.

(21) Appl. No.: 10/376,089

(22) Filed: Feb. 28, 2003

(65) Prior Publication Data

US 2004/0144481 A1 Jul. 29, 2004

Related U.S. Application Data

(60) Provisional application No. 60/442,717, filed on Jan. 27, 2003.

(51) Int. Cl.
*B44C 1/165* (2006.01)
*B44C 1/18* (2006.01)
*A41B 1/00* (2006.01)

(52) U.S. Cl. ..... 428/195.1; 428/202; 428/206; 428/355 RA; 428/914; 2/77; 156/230

(58) Field of Classification Search ..... 156/230, 156/239, 240, 241, 247, 277, 289; 428/195.1, 428/202, 203, 204, 206, 207, 213, 343, 347, 428/349, 355 RA, 914; 2/69, 77, 78.1, 94, 2/95, 113, 114, 115; 40/586, 594, 595
See application file for complete search history.

(56) References Cited

U.S. PATENT DOCUMENTS

| | | | | | |
|---|---|---|---|---|---|
| 3,432,376 | A * | 3/1969 | Reed et al. | ..... | 156/234 |
| 4,037,008 | A * | 7/1977 | Tugwell | ..... | 428/200 |
| 4,627,110 | A * | 12/1986 | Tengs | ..... | 2/69 |
| 4,663,214 | A * | 5/1987 | Coburn, Jr. | ..... | 428/204 |
| 5,523,129 | A * | 6/1996 | McGeehan-Hatch | ..... | 428/13 |
| 5,601,431 | A * | 2/1997 | Howard | ..... | 434/79 |
| 5,888,615 | A * | 3/1999 | Mascarenhas et al. | ..... | 428/141 |
| 5,899,010 | A * | 5/1999 | Peck | ..... | 40/618 |
| 6,067,660 | A * | 5/2000 | Contini | ..... | 2/246 |
| 6,397,390 | B1 * | 6/2002 | Henderson et al. | ..... | 2/69 |

* cited by examiner

*Primary Examiner*—Sue A. Purvis
(74) *Attorney, Agent, or Firm*—Amster, Rothstein & Ebenstein LLP

(57) ABSTRACT

An interactive-design garment which has heat-affixed thereto a flexible substrate formed of a laminate including a layer of plastisol ink which includes a primary graphic image therein of a particular theme and a plurality of flexible PVC sheet appliques which have secondary graphic images thereon and are positionable onto the substrate by a user to cooperate artistically with the graphic theme of said substrate on the garment.

14 Claims, 3 Drawing Sheets

INTERACTIVE-DESIGN GARMENT WHERE THE WEARER CAN CREATE AND ALTER THE GRAPHIC DECORATION ON THE GARMENT AND METHOD OF MANUFACTURING SAME

BACKGROUND OF THE INVENTION

1. Field of the Invention

This application claims the benefit Provisional Application Ser. No. 60/442,717 filed Jan. 27, 2003.

2. Description of the Related Art

There are numerous prior art methods of applying graphic designs onto garments and other articles. Direct application of designs includes hand painting and silk screening which methods are often extremely attractive but labor intensive and relatively expensive. Alternatively, graphics can be applied first to a substrate which is subsequently permanently affixed to a garment by sewing where the substrate is cotton or other natural fiber and by lithographic (litho) transfer where the substrate is PVC or other suitable plastic.

In the high volume and highly competitive field of T-shirt and sweatshirt sales, graphic illustrations on the garments is the key to success with relevant factors including quality and attractiveness of the graphics, permanence of the graphics, comfort of the shirts for the wearer and economics for the manufacturer.

The common litho transfer process where graphics are applied onto a PVC substrate which is then affixed under heat and pressure conditions to the garment, meets some of the above listed objectives; however, this process includes certain problems and compromises as relates to T-shirts and other garments. Often the litho transferred substrate has a matte surface, and a graphic image on such a surface is inherently hazy and not sharp. Such PVC substrate is often relatively thick and thus uncomfortable to a person who wears a T-shirt with such substrate on the front surface. Also, since such matte surface is inherently rough, it is not suitable to receive and hold any additional ornamentation and not suggestive for consideration of such supplemental design.

In an attempt to produce sharper images the matte surfaces of vinyl sheet substrates were modified to be smoother; however a different problem was encountered in that ink applied to very smooth surfaces did not adhere properly and smeared.

It was further discovered that if a PVC substrate were made transparent, graphics could be applied on the rough side and were visible on the smooth side. However, such graphics being seen through the relatively thick vinyl sheet lacked vivid realism that was available with sharp graphics on the exposed surface of a carrier sheet. Also, such vinyl sheet was relatively thick and thus bulky, heavy, stiff and not comfortable for a wearer of such garments. Since a T-shirt is traditionally one of the most comfortable garments, such graphic substrates, while decorative, greatly compromised the usefulness of the garment.

In view of the above, commercially produced decoration on clothing is most commonly done by graphic design in an original fabric by printing, weaving, knitting, silk screen or hand painting, or by a having a graphic design imprinted on a patch or applique which is then attached to a fabric by sewing, adhesive or heat bonding, as appropriate.

Obviously, users could create their own decorations by tie-dying, hand painting or by sewing or glueing patches on garments. Some of these processes by users are easy and some not, but except as used by a competent artist, none produce professional-looking graphics of the type usually associated with commercial products.

Other situations where users create their own designs include children's games where felt appliques are removably adhered to cloth or other appliques are removably adhered using Velcro® hook and loop fastening means, or PVC appliques are removably adhered to rigid flat boards or onto glass where the substrate is PVC onto which an image has been imprinted.

A variety of prior art devices and techniques relating to the general concept of changeable designs in garments and other articles are disclosed in the U.S. patents as described below.

U.S. Pat. No. 4,354,282 to Langdon discloses a garment with a front panel where markers to display a game score are attachable by hook and loop type fasteners. The combined panel, fastening means and markers is substantially thick and bulky.

U.S. Pat. No. 5,210,881 to Stocker et al. discloses an external pocket which can hold a removable object such as a toy bear.

U.S. Pat. No. 5,665,448 to Graham et al. discloses manipulatives made of paper, cloth or plastic formed from a meltblown web having an opposite charge as that of a substrate, which may carry a negative surface potential of between 100 to −2500 volts.

U.S. Pat. No. 5,734,991 to Schmid discloses a garment with a graphic scene onto which complementary objects can be attached by hook and loop fasteners.

U.S. Pat. No. 4,900,604 to Martinez et al. discloses substrate sheets for attachment to walls and appliques for attachment for the substrates by hook and loop fasteners.

SUMMARY OF THE NEW INVENTION

This invention solves problems described above in the garment decoration art by applying concepts from different fields to produce a novel interactive-design garment and a novel method of manufacturing same.

It is an object of this invention to provide an interactive-design garment where the user can decorate and readily revise his or her own decoration, and where the procedure is easy, quick, inexpensive and displays a vivid graphic illustration of quality-looking art work.

Another object is to have a PVC substrate on a garment where the substrate is thin, soft and pliable and comfortable to wear and has a very smooth shiny outer surface onto which a user can removably attach decorative appliques.

The present invention achieves these objects by using a new combination of features and techniques. With this invention the PVC layer is extremely thin and substantially flexible which leaves the garment soft and comfortable. Also, the graphics are vivid and not limited or degraded, as occurs with an image imprinted onto common matte surface of PVC. Finally, the exposed outer surface of the graphics is so smooth and soft that it can readily receive and hold removable PVC decals or appliques which have a similar smooth and pliable engagement surfaces.

Because this PVC substrate on the garment has the properties of softness, vivid graphics and ability to hold repeatedly removable decals, we have been able to incorporate the concept of interactive decoration and design, whereby the user of the garment (or other article) may apply decals of his or her choice in an artistic pattern of his choice onto the substrate.

In a preferred embodiment the substrate illustration has a defined primary graphic theme, and the plurality of repeatedly removable decals or appliques have their own secondary graphics which complement or cooperate with the primary graphics on the substrate or has an artistic relationship therewith. One example of an interactive theme is to have a heavens scene on the substrate and to have images of different planets or horoscopic symbols on the decals which can be adhered to the substrate in various positions and orientations and repeatedly removed and replaced.

The decals or appliques for attachment to the new PVC substrate are made from vinyl sheets which have a very smooth first side surface which readily adheres to a similarly smooth outer surface on the PVC substrate and an opposite surface on which graphics are applied.

The preferred embodiment of the new PVC substrate is a laminate of four layers bonded together in overlying relationship. Such laminate is created on lithographic release paper from which the substrate is later fixedly attached to a garment by standard litho transfer techniques. The laminate is created by application onto release paper of a succession of first through fourth layers, namely, a first layer of thin, clear PVC which becomes the exposed outer surface of the substrate, a second layer of the plastisol ink comprising PVC resins and plasticizer which incorporates the primary graphic image and is applied by known lithographic techniques, a third layer of white or other opaque plastisol adhesive that seals said second layer, and a fourth layer of clear plastisol adhesive mixed with glitter, typically in a ratio of about 4:1. This glitter comprises polyester chips or equivalent normally intended to be a highly visible decoration. It has been discovered that such glitter can be mixed with clear or other color plastisol adhesive and applied as the fourth layer of the above-described laminate, where such fourth layer provides stability to the laminate while not diminishing the desired softness and flexibility or pliability. Thus, this glitter has a primarily structural function, and in fact is not decorative since it is situated behind the first, second and third layers. Notwithstanding this unexpected useful structural function of the glitter, it may also have a decorative function if a window of space is created in the ink and white adhesive layers through which the glitter layer may show through.

While this glitter layer provides body to the ink layer, the thin PVC layer listed as the first layer provides the very smooth outer surface to which the PVC appliques adhere better than they would to the second layer of ink if uncoated.

The final product is a litho transfer of substantial thinness, vivid graphics and a very smooth outer surface. This litho transfer is applied to a garment under appropriate heat and pressure conditions so that it becomes permanently affixed to the garment, and the release paper is removed. This thin substrate is soft and pliable and has an exposed outer surface highly receptive to hold complementary PVC decals. The adherence of these decals by their smooth side surface onto the smooth outer surface of the PVC substrate may be from static electricity conditions or from suction or other adhesion phenomenon due to the application of two very smooth and pliable surfaces together with substantially all air eliminated between these surfaces and/or an interactivity of the mating PVC surfaces.

The resulting combination is an interactive-design assembly of PVC substrate formed on a garment with complementary PVC decals having a special relationship whereby the user can create and repeatedly vary his or her own design on his or her own garments.

With the present invention, adults and children can design and re-design the graphics on their clothing instead of discarding or simply not using favored garments whose decoration is no longer favored, and they can create special effect decorations for special occasions. The users can readily experience personal artistic expressions and produce good artwork, because the primary substrate and the decals have professionally-made graphics to start with, and the users are merely re-arranging them. Manufacturers can produce shirts which are entertaining, educational, comfortable and economical.

DETAILED DESCRIPTION OF THE PREFERRED EMBODIMENT

Figure 1:
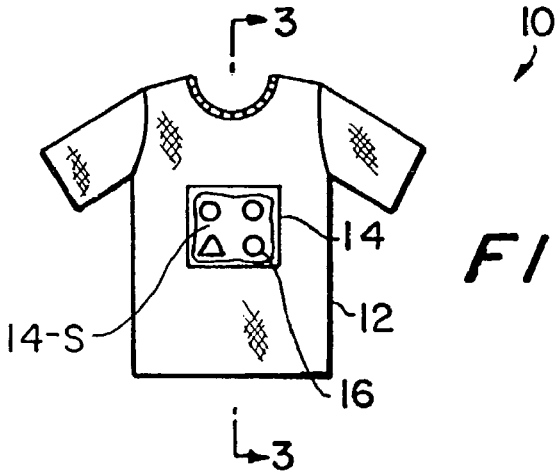
FIG. 1 is a front elevation view of the new interactive garment including a PVC substrate and removable decals.
Figure 2:
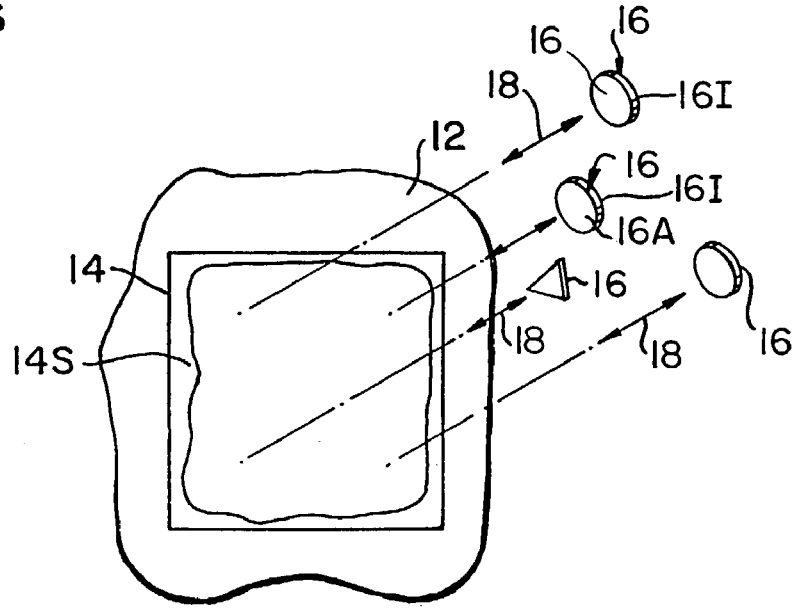
FIG. 2 is a portion of FIG. 1 shown in a exploded view.
Figure 3:
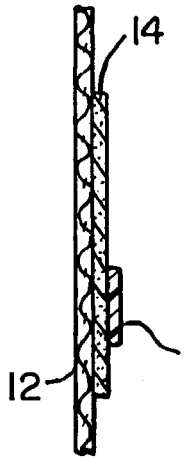
FIG. 3 is a partial sectional view taken along line 3—3 in FIG. 1.

FIGS. 1, 2 and 3 show a product 10 of the present invention in the form of a T-shirt 12 including a PVC substrate 14 with an outer surface 14S on which appears a principal graphic image, a plurality of removable decals 16, each having an inner surface 16A and an outer surface 16I with its own secondary image thereon. This is a typical prior art T-shirt knit of 100% cotton fiber; however, this invention is well suited to other garments made of any fiber onto which a PVC substrate is adherable when applied with known heat and pressure techniques.

The invention of FIGS. 1–3 may function as a kit or assembly which includes the garment 12, the PVC substrate 14 and the removable PVC decals 16. In FIG. 2 each of the decals 16 is shown with a two-headed arrow 18 which signifies that each decal can be repeatedly applied to and attached, removed and re-attached to the outer surface 14S of the PVC substrate 14 pursuant to the wishes and creative inclinations of the garment's user.

As will be explained in greater detail below, the principle substrate 14 is created from plastisol ink which forms a graphic image or artwork and a plurality of additional layers. The image comprises a graphic theme. Each decal has on its outer surface a graphic image 16I which has some logical relationship to the theme of image. Each decal will readily adhere in any location and in any orientation onto surface as the user creates and re-creates his or her own design or artwork.

Figure 5:
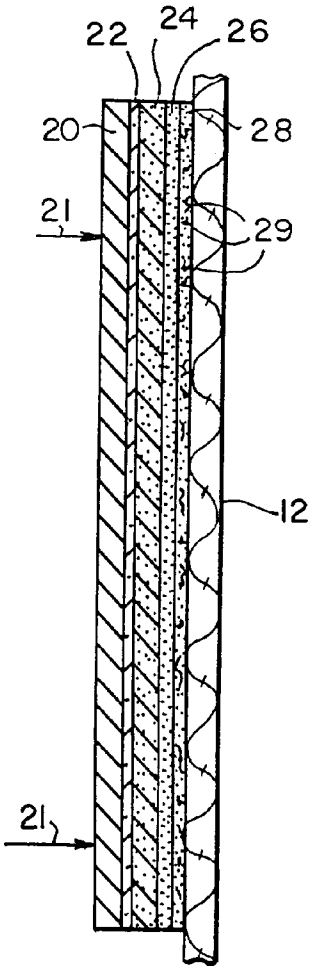
FIG. 5 is sectional view similar to FIG. 4, showing this new substrate applied to garment.
Figure 4:
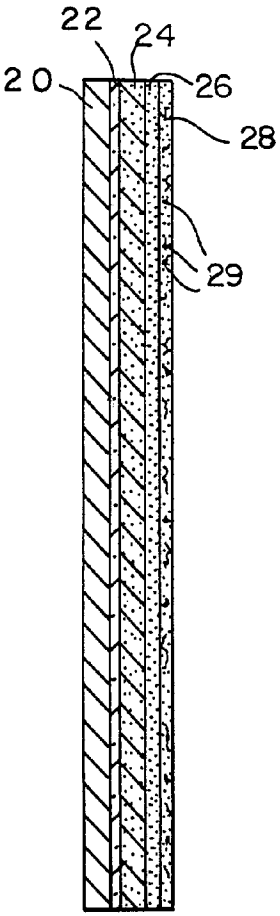
FIG. 4 is an enlarged sectional view corresponding to FIG. 3 and showing the layers comprising the new substrate.

FIGS. 4 and 5 show in a preferred embodiment how the new PVC substrate is created and applied to a shirt. The procedure begins with a sheet of standard transfer release paper 20 commonly designated T-75 and available from sources such as Wyndstone Specialty Products in Wheeling, Ill. or Union Ink Company in Ridgefield, N.J. A very thin layer or coating 22 of clear PVC is applied by spray or roller technique onto the entire exposed outer surface of the release paper. Next, the graphic image layer 24 is created by applying plastisol ink onto lithographic offset drum(s) (not shown) from which this image is transferred onto the PVC layer 22 on the release paper 20. The creation of this graphic image layer 24 formed of plastisol ink is achieved by standard silk screen techniques using rollers for the sequence of color impressions selected to create the graphic image. Next, a layer of white plastisol adhesive 26 is applied by squeegee to cover and seal the ink layer 24, and this layer 26 is cured for about five seconds with heat from coils of a flash unit (not shown) using apparatus and techniques known in the art. This adhesive layer 26 needs to be applied and cured within seventy-two hours of the application of the ink layer 24 in order for the ink substrate to achieve and maintain the desired body, strength and softness.

After said cure the release paper 20, now including the PVC layer 22, plastisol ink layer 24 and white plastisol adhesive layer 26, is directed to an in-line press or other apparatus where it receives a coating of clear plastisol adhesive 28 into which has been added common glitter, such as silver polyester chips that will pass through a silk screen having 0.008 inch by 0.008 inch apertures. This glitter is mixed into the plastisol adhesive in a ratio of about 1 to 4 of glitter to adhesive. This layer 28 of adhesive plus glitter 29 is cured for about three seconds by flash unit heating coils mentioned above. This glitter layer 28, which is essentially not visible since it is behind the white adhesive layer which is behind the ink layer, provides stability and body to the ink substrate 24 while still allowing softness and flexibility. It is possible for the glitter to be visible, if desired, in very specific areas where the ink layer 24 and white adhesive layer 26 have intentional omissions through which the glitter would appear.

Thus, while glitter in normal or traditional use is a decorative aspect or layer to be readily visible in graphic artwork, here it is essentially non-visible and has been discovered to be ideal for producing a plastisol ink substrate having new characteristics that make possible the present interactive-design garment.

While the components or ingredients described above, including plastisol ink, clear and white plastisol adhesive and glitter are readily available from sources like Union Ink Company and elsewhere, the arrangement and sequence described above to produce the new plastisol ink substrate and this in combination with the now highly-adherable decals in the interactive-design garment is believed to be new and not suggested in any of the known relevant prior art.

FIG. 5 shows the lithographic transfer paper 20 of FIG. 4 positioned for application of the graphic substrate onto garment 12 with the glitter-adhesive layer 28 situated adjacent and in contact with garment 12. With a known heat-transfer machine there is an application of heat and pressure as indicated by arrows 21 to the outer surface of the transfer paper 20, under normal parameters for the industry, an example being where the temperature is about 375° F. under a pressure of about 100 psi for a time period of about 12 seconds.

Figure 6:
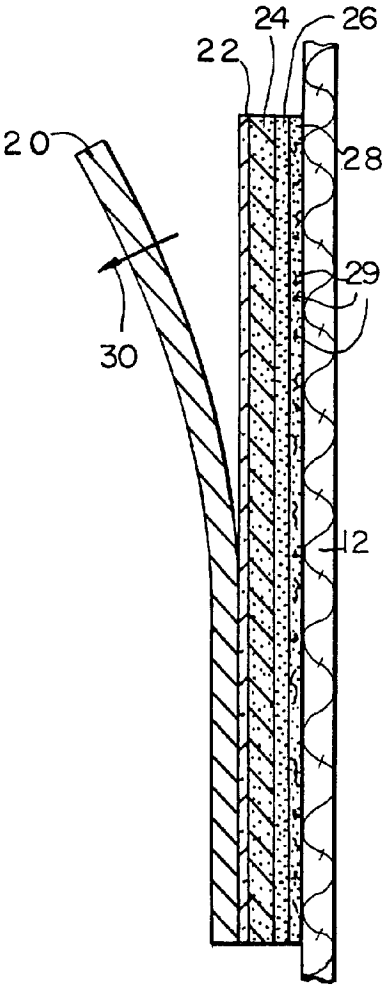
FIG. 6 is a sectional view similar to FIG. 5 showing the new substrate adhered to a garment and the release paper being pealed off.

Next is a standard cool-down period as indicated in FIG. 6, after which the release paper 20 is pealed off as indicated by arrow 30, leaving exposed the outer PVC layer 22 on the ink substrate 24, behind which are the adhesive sealing layer 26 and supporting and thickening layer 28.

The outermost layer 22 seen in FIG. 6 is the earlier described very thin and very smooth coating of clear PVC through which the ink image is clearly visible. To this smooth and relatively soft outermost layer 22 decals 16 will readily adhere, but are easily and repeatedly removable and re-adherable. These decals are formed out of static vinyl sheet or equivalent with an adhesive backing sheet, known in the industry as white static vinyl available in rolls 30", 36" and 48" wide, 40 yards long and 0.008 to 0.010 inches thick from sources such as Plastiprint, Inc. in Lakewood, Colo. By standard printing techniques such as Flexography roll press or "Flexoprint" and photo engraving, graphic images are applied to the top side of the static vinyl sheet. In a typical preferred embodiment water soluble ink is applied and then coated with clear PVC or other plastic to create a water and scratch-resistant surface. Individual decals are formed by a kiss-cut process, whereby the decals are cut through the vinyl sheet and later pealable off the backing sheet. The back (unprinted side) of the decal remains extremely smooth for the above-described excellent adherence to the outer surface 22 of the ink substrate on the garment.

The above-mentioned plastisol ink is well-known in the industry and available from many sources such as Union Ink Company. Such inks include a plasticizer available under the chemical name di-ethylhexyl-phthalate (DEHP) from suppliers, including B.F. Goodrich (Worldwide) and Teknor Apex of Pawtucket, R.I. This ink has thixotropic property, in that its viscosity increases with mechanical motion. Accordingly, this ink is stirred immediately prior to use. It is contemplated within the scope of this invention to use alternate ink compositions which glow in the dark or have reflective characteristics or which include glitter in the ink.

Figure 7:
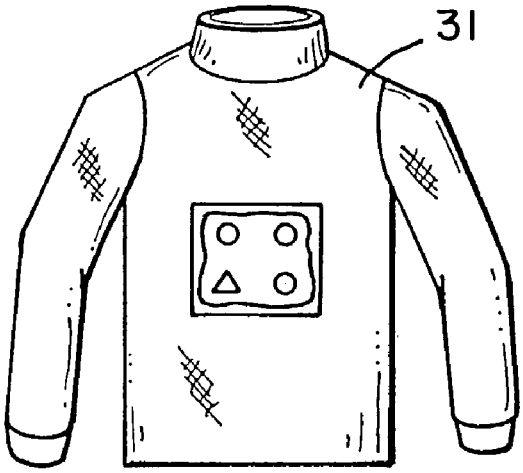
FIG. 7 is a front elevation view similar to FIG. 1, showing the present invention as used on a sweatshirt.
Figure 8:
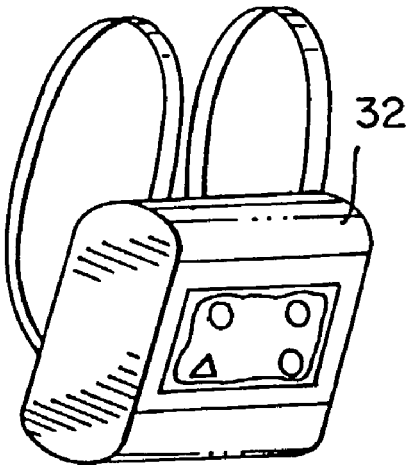
FIG. 8 is a front elevation view similar to FIG. 1 showing the present invention as used with a backpack.

FIGS. 7 and 8 illustrate other embodiments of the kit or assembly of this invention, where the article receiving the PVC substrate is a sweatshirt 31 or a backpack 32, both having a fabric or sheet base onto which the PVC substrate is permanently affixed. Thereafter, the decals are removably attached as part of this interactive-design invention.

The preferred embodiment of the present invention is a garment adapted for interactive graphic design by the wearer of the garment. Interactive graphic design is possible and is encouraged because the garment has a permanent graphic substrate on its surface, and the wearer is provided with a plurality of appliques bearing graphic designs which complement or cooperate with the substrate design to produce an unlimited variety of graphic design combination. For example, the substrate design might be a forest scene and the appliques could be forest animals or flowers which the user could blend or compose with the forest design on the substrate.

The background design appearing in FIGS. 1 through 8 comprises a simple outline of an irregular periphery with appliques bearing simple geometric shapes. These are merely exemplary of a myriad of possible design combinations which may be intricate or simple, and plain or deeply meaningful. The user may choose to apply an obviously logical combination or to experiment with abstract and/or emotional presentations.

In any event, because of the physical characteristics of the mating surfaces of the PVC substrate and the appliques, these appliques will readily adhere in any orientation and can be removed and reapplied at will. The result is thus an interactive-design garment that has many advantages over prior art garments and other articles which have fixed, non-changeable graphic designs applied to their outer surfaces.

Although certain preferred embodiments of the invention have been herein described in order to afford an enlightened understanding of the invention and to describe its principles, it should be understood that the present invention is susceptible to modification, variation, innovation and alteration without departing or deviating from the scope, fair meaning and basic principles of the appended claims.

What is claimed is:

1. An interactive-design garment kit for a user to create and repeatedly vary a graphic design comprising a primary graphic theme and secondary graphic images on a garment, comprising:

a. a garment formed of a fabric with an outer surface, b. a substantially flexible substrate comprising plastisol ink, said substrate having an inner surface heat-affixed to said outer surface of said garment and an exposed outer surface that is substantially smooth and includes thereon said primary graphic theme, and c. a plurality of appliqués, each formed of flexible sheet PVC having a substantially smooth inner surface and an outer surface bearing said secondary graphic image, each of said plurality of appliqués having an inner surface area less than that of said outer surface of said substrate, and each being affixable to said substrate on said primary graphic theme by applying said smooth surface of said appliqué onto said smooth outer surface of said substrate to create said graphic design, and each being repeatedly easily removable and re-affixable to said substrate to vary said graphic design, wherein each of said secondary graphic images cooperates with said primary graphic theme to form said graphic design.

2. A kit according to claim 1 wherein each of said appliqués is cut from a sheet of static vinyl.

3. A kit according to claim 2 where said static vinyl has thickness of about 0.008 to 0.010 inches.

4. A kit according to claim 1 wherein substrate has thickness of about 0.001 inches.

5. A kit according to claim 1 wherein said garment is a T-shirt.

6. A substantially flexible substrate permanently affixable to the outer surface of a garment, said substrate formed as a laminate of first through fourth layers bonded together in overlying relationship, wherein said first layer comprises clear PVC and is the exposed outer layer of said substrate, said second layer comprises plastisol ink incorporating a primary graphic image therein, said third layer comprises opaque plastisol adhesive sealing said second layer, and said fourth layer comprises plastisol adhesive which includes glitter mixed therein.

7. A substrate according to claim 6 wherein said fourth layer comprises glitter and plastisol adhesive in the ratio of about 1 to 4.

8. An interactive-design garment and multiple appliqués combination for a user to create and repeatedly vary a graphic design comprising a primary graphic theme on said garment and secondary graphic images on said appliqués, comprising:

a. a garment formed of a fabric with an outer surface, b. a substantially flexible substrate comprising plastisol ink, said substrate having an inner surface heat-affixed to said outer surface of said garment and an exposed outer surface that is substantially smooth and includes thereon said primary graphic theme, and c. a plurality of appliqués, each formed of flexible sheet PVC having a substantially smooth inner surface and an outer surface bearing one of said secondary graphic images, each of said plurality of appliqués having an inner surface area less than that of said outer surface of said substrate, and each being affixable to said substrate on said primary graphic theme by applying said smooth surface of said appliqué onto said smooth outer surface of said substrate to create said graphic design, and each being repeatedly easily removable and re-affixable to said substrate to vary said graphic design, wherein each of said secondary graphic images cooperates with said primary graphic theme to form said graphic design.

9. An interactive-design garment kit for a user to create and repeatedly vary a graphic design comprising primary and secondary graphic images on a garment, comprising:

a garment formed of a fabric with an outer surface, a substantially flexible substrate comprising plastisol ink, said substrate having an inner surface heat-affixed to said outer surface of said garment and an exposed outer surface that is substantially smooth and includes thereon said primary graphic image, wherein said substrate is a laminate of first through fourth layers bonded together in overlying relationship, wherein said first layer comprises clear PVC and is said exposed outer surface of said substrate, said second layer comprises plastisol ink incorporating a primary graphic image therein, said third layer comprises opaque plastisol adhesive sealing said second layer, and said fourth layer comprises plastisol adhesive which includes glitter mixed therein, and a plurality of appliqués, each formed of flexible sheet PVC having a substantially smooth inner surface and an outer surface bearing said secondary graphic image, each of said plurality of appliqués having an inner surface area less than that of said outer surface of said substrate, and each being affixable to said substrate on said primary graphic image by applying said smooth surface of said appliqué onto said smooth outer surface of said substrate to create said graphic design, and each being repeatedly easily removable and re-affixable to said substrate to vary said graphic design.

10. A kit according to claim 9 wherein said fourth layer comprises glitter and plastisol adhesive in the ratio of about 1 to 4.

11. A kit according to claim 10 wherein said glitter comprises polyester chips that will pass through a silk screen having 0.008 inch by 0.008 inch apertures.

12. A kit according to claim 9 wherein said plastisol adhesive of said third layer has a generally white color.

13. A kit according to claim 9 wherein said plastisol adhesive of said fourth layer is clear.

14. A kit according to 9 wherein said first layer has thickness of about 0.0005 inches.

* * * * *